US009541364B2

(12) United States Patent
Facciano et al.

(10) Patent No.: US 9,541,364 B2
(45) Date of Patent: Jan. 10, 2017

(54) ADAPTIVE ELECTRONICALLY STEERABLE ARRAY (AESA) SYSTEM FOR INTERCEPTOR RF TARGET ENGAGEMENT AND COMMUNICATIONS

(71) Applicant: Raytheon Company, Waltham, MA (US)

(72) Inventors: Andrew B. Facciano, Tucson, AZ (US); Rodney H. Krebs, Oro Valley, AZ (US); Michael S. Bielas, Tucson, AZ (US); Cody D. Tretschok, Tucson, AZ (US); Michael S. Spangler, Vail, AZ (US); Benjamin Mitchell, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 24 days.

(21) Appl. No.: 14/494,105

(22) Filed: Sep. 23, 2014

(65) Prior Publication Data

US 2016/0084623 A1 Mar. 24, 2016

(51) Int. Cl.
*F42B 30/00* (2006.01)
*H01Q 1/42* (2006.01)
(Continued)

(52) U.S. Cl.
CPC ..... *F42B 30/006* (2013.01); *F41G 7/008* (2013.01); *F41G 7/2246* (2013.01);
(Continued)

(58) Field of Classification Search
CPC ..... F42B 30/006; F42B 15/01; H01Q 3/24; H01Q 1/28
See application file for complete search history.

(56) References Cited

U.S. PATENT DOCUMENTS 4,494,121 A * 1/1985 Walter ..... H01Q 1/286 343/708
4,615,496 A * 10/1986 Pinson ..... F41G 7/008 244/3.16

(Continued)

OTHER PUBLICATIONS

Wikipedia, "Beyond-visual-range missile", https://en.wikipedia.org/wiki/Beyond-visual-range_missile. Archived on Oct. 24, 2012 by Internet Arhive, http://web.archive.org/web/20121024000634/http://en.wikipedia.org/wiki/Beyond-visual-range_missile. Accessed Mar. 21, 2016.*

(Continued)

*Primary Examiner* — Tien Dinh
*Assistant Examiner* — Alexander V Giczy
(74) *Attorney, Agent, or Firm* — Eric A. Gifford

(57) ABSTRACT

An adaptive electronically steerable array (AESA) system comprises a plurality of arrays, each comprising a plurality of radiating elements, each array configured for placement on a forward-facing surface of a different one of a plurality of aerodynamic control surfaces on an interceptor. A plurality of radio frequency (RF) transmissive radome elements, each having an aerodynamic shape complementary to the aerodynamic control surface, are placed over one of the arrays. Control circuitry configures the arrays, independently or in concert, for RF target engagement and communication. Additional arrays may be positioned on side or aft-facing surfaces of the aerodynamic control surfaces for RF communication. The AESA system may be paired with an IR system for dual-mode operation.

21 Claims, 10 Drawing Sheets

(51) Int. Cl.

| | |
|---|---|
| ***H01Q 3/24*** | (2006.01) |
| ***H01Q 1/28*** | (2006.01) |
| ***F42B 15/01*** | (2006.01) |
| ***F41G 7/00*** | (2006.01) |
| ***F41G 7/22*** | (2006.01) |

(52) U.S. Cl.
CPC ..... *F41G 7/2253* (2013.01); *F41G 7/2286* (2013.01); *F41G 7/2293* (2013.01); *F42B 15/01* (2013.01); *H01Q 1/28* (2013.01); *H01Q 1/42* (2013.01); *H01Q 3/24* (2013.01)

(56) References Cited

U.S. PATENT DOCUMENTS

| | | | | |
|---|---|---|---|---|
| 4,686,535 | A * | 8/1987 | Lalezari | H01Q 21/065 343/700 MS |
| 4,912,477 | A * | 3/1990 | Lory | H01Q 1/287 342/372 |
| 5,132,693 | A * | 7/1992 | Werp | B64C 1/36 342/179 |
| 5,283,587 | A * | 2/1994 | Hirshfield | H01Q 21/064 342/361 |
| 5,400,040 | A * | 3/1995 | Lane | H01Q 1/286 343/700 MS |
| 5,483,894 | A | 1/1996 | Facciano et al. | |
| 5,861,856 | A * | 1/1999 | Beele | H01Q 1/28 343/708 |
| 5,923,302 | A * | 7/1999 | Waterman | H01Q 1/28 343/727 |
| 6,606,066 | B1 | 8/2003 | Fawcett et al. | |
| 6,924,772 | B2 | 8/2005 | Kiernan, Jr. et al. | |
| 8,074,516 | B2 | 12/2011 | Facciano et al. | |
| 2005/0206563 | A1* | 9/2005 | Guy | H01Q 3/24 342/372 |
| 2005/0240341 | A1 | 10/2005 | Fielhauer et al. | |
| 2008/0122683 | A1 | 5/2008 | Howley et al. | |
| 2008/0158055 | A1* | 7/2008 | Paynter | H01Q 3/38 342/375 |
| 2009/0314878 | A1* | 12/2009 | Raviv | F41F 3/04 244/3.11 |
| 2009/0323047 | A1 | 12/2009 | Karazi et al. | |
| 2010/0066631 | A1* | 3/2010 | Puzella | H01Q 1/02 343/853 |
| 2010/0292871 | A1 | 11/2010 | Schultz et al. | |
| 2010/0328188 | A1 | 12/2010 | Chang et al. | |
| 2012/0200449 | A1 | 8/2012 | Bielas | |
| 2012/0326939 | A1 | 12/2012 | Cannon et al. | |
| 2013/0214972 | A1* | 8/2013 | Woodell | H01Q 1/281 342/372 |

OTHER PUBLICATIONS

Sean Gallagher, "Radars perform double duty as high-speed data links", Defense Systems, Jul. 2, 2009. https://defensesystems.com/articles/2009/07/08/defense-it1-radar.aspx, accessed Mar. 21, 2016.*

Toby Haynes, A Primer on Digital Beamforming, Spectrum Signal Processing, Mar. 26, 1998.

Lal C. Godara, Application of Antenna Arrays to Mobile Communications, Part II: Beam-Forming and Direction-of-Arrival Considerations, Proceedings of the IEEE, vol. 65, No. 8, Aug. 1997.

Harris Communications, Government Communications Systems Phased Array Antennas,Government Communications Systems Division | P.O. Box 37 | Melbourne, FL USA 32902-0037, Copyright 2004 Harris Corporation.

Dr. Eli Brookner, Phased-Array Radars: Past, Astounding Breakthroughs and Future Trends, Microwave Journal, vol. 51, No. 1, Jan. 2008.

Dr. Yasser Al-Rashid, Active Phased Array Radar Systems, Lockheed Martin MS2, Raday Systems, Nov. 17, 2009.

Krim et al., Two Decades of Array Signal Processing Research, IEEE Signal Processing Magazine, Jul. 1996.

Moore et al., Common Seeker / Kinetic Kill Vehicle Concept, U.S. Army Space and Strategic Defense Command, Jun. 28, 1995.

* cited by examiner

ADAPTIVE ELECTRONICALLY STEERABLE ARRAY (AESA) SYSTEM FOR INTERCEPTOR RF TARGET ENGAGEMENT AND COMMUNICATIONS

BACKGROUND OF THE INVENTION

Field of the Invention

This invention relates to adaptive electronically steerable arrays (AESAs), and more particularly to an AESA system for a missile interceptor comprising multiple AESA arrays positioned on forward facing surfaces of the interceptor's aerodynamic control surfaces for radio frequency (RF) target tracking and communications. Deployment of the AESA arrays on the aerodynamic control surfaces frees up volume, thus increasing design options for an IR seeker.

Description of the Related Art

Interceptors may be configured to use the RF band for target engagement (e.g. search, acquisition, targeting or terminal engagement) or for communications with another communication station (e.g. another interceptor, a different airborne platform, or ground or sea based system). Historically, the RF antenna would have been positioned behind the radome and had a fixed beam pattern within a field-of-view (FOV), either forward or side-looking. To increase the field-of-regard (FOR), the RF antenna could be mounted on a mechanical gimbal. In some systems, the RF Seeker was paired with an IR seeker to provide dual-band capability. Both systems are mounted within the radome, one forward-looking and the other side-looking. Incorporation of both systems typically required a larger and non-axisymmetric radome, and typically necessitated mechanical gimbal ling to achieve a desired FOR.

An AESA—active electronically scanned array: is a type of phased array radar whose transmitter and receiver functions are composed of numerous small solid-state transmit/receive modules (TRMs). AESA radars aim their "beam" by emitting separate radio waves from each module that interfere constructively at certain angles in front of the antenna. Advanced AESA radars can improve on the older passive electronically scanned array (PESA) radars by spreading their signal emissions out across a band of frequencies, which makes it very difficult to detect over background noise, allowing ships and aircraft to broadcast powerful radar signals while still remaining stealthy.

More recently, interceptors have replaced fixed RF antennas, and particularly mechanically gimbaled antenna with an AESA for RF target engagement. The AESA may be mounted in a forward-looking boresight configuration or a side-looking configuration within the radome. In a dual-band system, as before the AESA may be paired with a mechanically gimbaled IR seeker. Typically, the IR seeker is mounted in the forward-looking position and the AESA is mounted in a side-looking position behind the non-axisymmetric radome.

The AESA has also been developed for use in RF communications when more than one frequency band is used. US 2012/0200449 discloses an AESA system in which multiple arrays of radiating elements and control circuitry to configure the arrays for multi-band and multi-aperture operations are deployed to maintain data links with communication satellites. The arrays are located circumferentially around the interceptor and the control circuitry is configured to switch between the arrays as the interceptor spins to maintain communications with the satellite.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an AESA system for interceptor RF target engagement and communications.

In an embodiment, the AESA system comprises a plurality of arrays, each comprising a plurality of radiating elements, each array configured for placement on a forward-facing surface of a different one of a plurality of aerodynamic control surfaces on the interceptor. A plurality of RF transmissive radome elements, each having an aerodynamic shape complementary to the aerodynamic control surface, are placed over one of the arrays. Control circuitry configures the arrays for RF target engagement and communication.

In different embodiments, the control circuitry may configure the arrays to operate independently. For example, the arrays may scan their individual beam patterns to search for and acquire a target or different arrays may be used for RF target engagement and RF communication, either simultaneously or serially. The control circuitry may configure the arrays to operate in concert to form a single combined beam pattern with enhanced sensitivity. This may, for example, be used for target tracking or for communications. The control circuitry may configure the arrays for multi-band operation.

In different embodiments, additional AESA arrays may be positioned on side-facing or aft-facing surfaces of the aerodynamic control surfaces. The control circuitry may configure these additional arrays for RF communications.

In an embodiment, the AESA system is paired with an IR system for dual-mode operation. The IR system is mounted behind a dome on the nose of the interceptor. Because the AESA system is not co-located with the IR system in the dome, there is considerably more flexibility to design the IR system and the dome. For example, the dome may be axisymmetric and the IR system may not require mechanical gimballing. In some applications, a boresighted strapdown IR seeker may provide a sufficient FOR for the mission. Elimination of the mechanical gimbal saves weight, volume, cost and complexity.

In an embodiment of a dual-mode system, the AESA system may be initially configured to independently scan multiple beam patterns to search for and acquire a target. Once acquired, the AESA system may be configured to provide a single beam pattern with enhanced sensitivity to track the target during mid-course flight. Once the range-to-target has closed, the interceptor can use the boresighted strapdown IR seeker to image the target for terminal operations.

These and other features and advantages of the invention will be apparent to those skilled in the art from the following detailed description of preferred embodiments, taken together with the accompanying drawings, in which:

DETAILED DESCRIPTION OF THE INVENTION

The present invention describes an AESA system for RF target engagement and communications for interceptor. The AESA system comprises multiple arrays that are deployed on aerodynamic control surfaces of the interceptor. The arrays may be controlled independently or in concert for RF target engagement or communications. The AESA system may be paired with an IR system for dual-mode operation. Removal of the AESA system from the interceptor radome increases the design options for implementation of the IR system. For example, the dual-mode system may be able to eliminate the mechanical gimbal for the IR seeker and use an axisymmetric dome without sacrificing performance.

The interceptor may be any airborne vehicle that includes aerodynamic control surfaces. These surfaces may provide lift or maneuverability, may be fixed or moveable. For example, the interceptor may be a self-propelled missile, a gun-launched projectile, a unmanned aerial vehicle (UAV), a manned aircraft or a planetary lander (provided the destination planet has an atmosphere). Without loss of generality, the AESA system will be shown in described in the context of a missile interceptor having four fixed dorsal fins positioned every 90 degrees about the circumference of the interceptor. The dorsal fins are modified to incorporate the AESA arrays and radome elements.

Figure 1A:
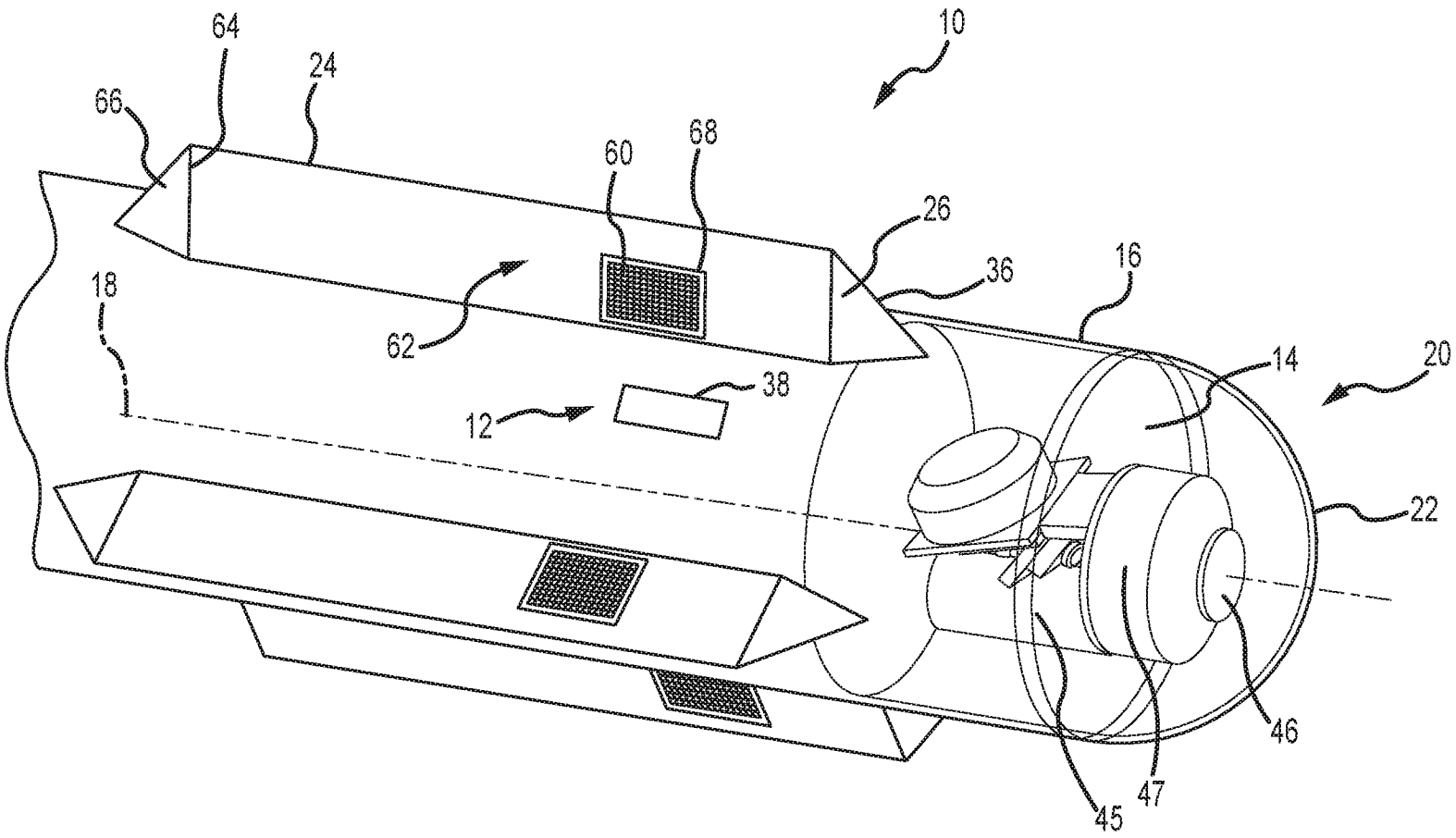
FIGS. 1*a* and 1*b* are perspective and side views of an embodiment a dual-mode missile seeker including an RF seeker having AESA arrays positioned on aerodynamic control surfaces and a strapdown IR seeker.
Figure 1B:
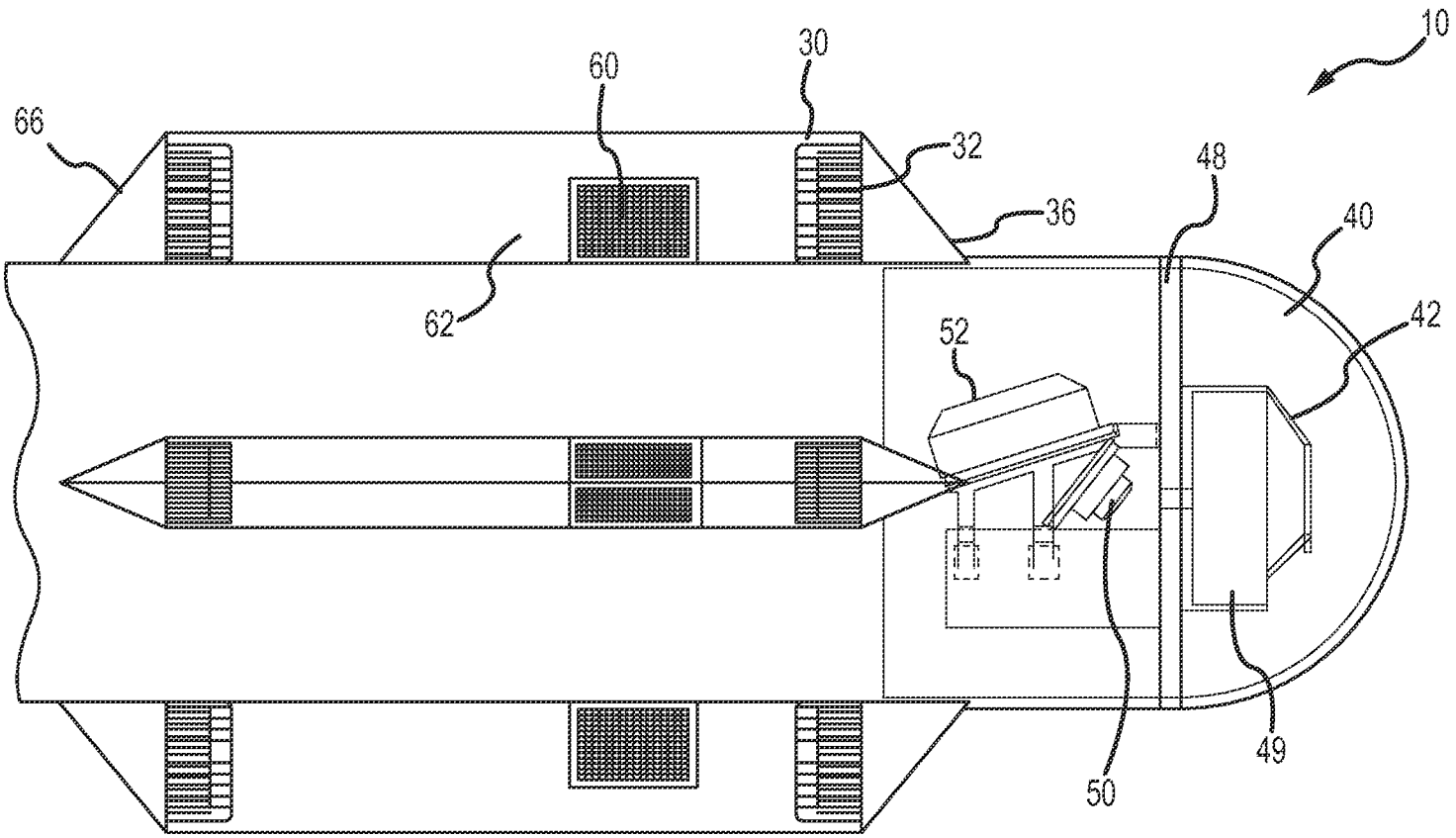

Referring now to FIGS. 1*a* and 1*b*, an embodiment of an interceptor 10 includes an AESA system 12 for RF target engagement and communications and an IR system 14 for terminal target engagement. Interceptor 10 includes a missile body 16, generally a cylindrical metal tube symmetric about a longitudinal axis 18, a payload 20 including a forward hemispheric dome 22, and 4 fixed dorsal fins 24 positioned every 90 degrees about the circumference of the interceptor and running the length of the interceptor. The dorsal fins provide aerodynamic stability for the missile interceptor. Each dorsal fin has a forward-facing surface 26 that is generally perpendicular to longitudinal axis 18. This surface will have a shape, triangular or rectangular, dictated by the cross-section of the fin.

AESA system 12 comprises a plurality of arrays 30, each comprising a plurality of radiating elements 32. Each array 30 is placed on a different one of the forward-facing surfaces 26 of the fins 24. As shown, each array 30 is connected to a power source such as the interceptor's power bus or a battery to power the radiating elements. A plurality of RF transmissive radome elements 36 are placed over respective arrays 30. The radome elements 36 are formed of a material such as ceramic or organic composite materials that is transmissive in the RF band and physically durable. Each radome element has an aerodynamic shape complementary to said aerodynamic control surface (fin) to maintain the aerodynamic properties of the control surface (fin). The exact shape of the radome element will depend on the cross-section of the fin. In some cases, the array of radiating elements may be larger than the exposed forward-facing surface 26, in which case, the size and shape of the radome element may be modified.

In this embodiment dorsal fin 24 has a triangular cross-section that defines a triangularly shaped forward-facing surface 26 on which an AESA array 30 is placed. AESA array 30 comprises a triangular arrangement of radiating elements 32 coupled to a power source. Radome element 36 has a solid triangular shape that is complementary to the triangular cross-section of fin 24.

Control circuitry 38 is connected to configure the arrays 30 for RF target engagement. The control circuitry may be integrated with other control circuitry on the interceptor that performs other tasks such as general avionics or guidance.

In different embodiments, the control circuitry 38 may configure the arrays 30 to operate independently. For example, the arrays may scan their individual beam patterns to search for and acquire a target. Or different arrays may be used for RF target engagement and RF communication, either simultaneously or serially. The control circuitry may configure the arrays to operate in concert to form a single combined beam pattern with enhanced sensitivity. This may, for example, be used for target tracking or for communications. The control circuitry may configure the arrays for multi-band operation. This may be done, for example, by configuring each radiating element in an array to operate as a single aperture in a first frequency band and by configuring a subset of the radiating elements in an array to operate as a single aperture in a second frequency band. Multi-band operation may be used for either target tracking or communication.

In this embodiment of interceptor 10, the AESA system 12 is paired with IR system 14 for dual-mode operation. In general, IR system 14 can be any system that can be located in the payload 20 behind forward looking IR dome 22, which is formed of materials that are transmissive in the IR band. The IR system may be fixed or gimbaled, and may be forward or side looking. However, because the AESA system is not co-located with the IR system in the IR dome, there is considerably more flexibility to design the IR system and the IR dome. For example, the IR dome may be axisymmetric and the IR system may not require mechanical gimballing. Elimination of the mechanical gimbal saves weight, volume, cost and complexity. Axisymmetric IR domes are less complicated to fabricate, hence less expensive.

In this embodiment, IR system 14 comprises a bore-sighted strapdown IR seeker 40 with an axisymmetric (hemispheric) dome 22. The strapdown IR seeker 40 comprises an optical telescope 42 and one or more Focal Plane Arrays (PFAs) 44. The optical telescope focuses an enlarged image onto the one or more FPAs for image digitization. The optical telescope combines a number of optical elements e.g. reflective mirrors and/or optical lenses. The telescope may comprise primary, secondary, and possible tertiary optical elements and beam splitters for multiple color FPA input. Once digitized the on board computer can determine target motion to calculate the proper maneuver commands for ultimate interception. The optical telescope has no moving parts, hence is easier and less expensive to produce with greater reliability.

In this embodiment, the IR seeker is a two-color system. The optical telescope includes a primary mirror 45 and a secondary mirror 46 that focus an enlarged image through a hole 47 in bulkhead 48. A sunshade 49 prevents extraneous light from entering the optical system. A beam splitter (not shown) behind the bulkhead splits the focused light into first and second colors and directs the respective colors to a first FPA 50 and a second FPA (not shown). An Inertial Measurement Unit 52 is also mounted behind the bulkhead.

In an alternate embodiment, additional AESA arrays 60 may be deployed at other locations on the interceptor to increase the FOR for RF target engagement or RF communications. The individual and combined beam patterns for the AESA arrays 30 deployed on the forward surfaces of the fins are limited to project in a generally forward direction from the interceptor. In most scenarios this should be sufficient for RF target engagement. However, this configuration does limit the capability for RF communications to communication stations (other inerceptors, other airborne vehicles for advanced cueing, ground stations) that are in front of the interceptor. Additional AESA arrays 60 could be deployed in a side-looking on side-facing surfaces 62 of the dorsal fins, or on an aft-facing surface 64 of the dorsal fin. The arrays on the aft-facing surfaces would be covered with a radome element 66 similar to the forward-facing arrays. The arrays on the side-facing surfaces would be covered with a flat radome element 68.

Figure 2A:
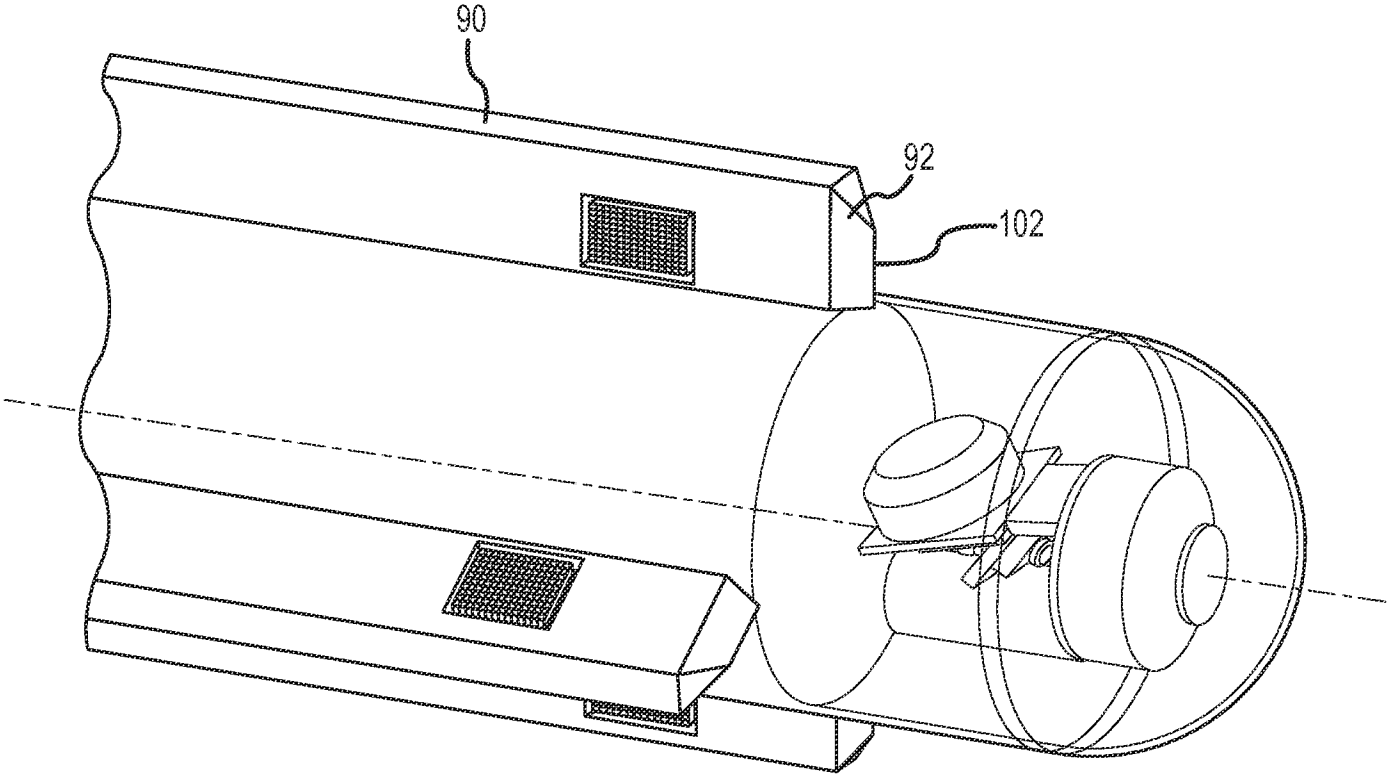
FIGS. 2*a* and 2*b* are perspective and side views of another embodiment a dual-mode missile seeker including an RF seeker having AESA arrays positioned on aerodynamic control surfaces and a strapdown IR seeker.
Figure 2B:
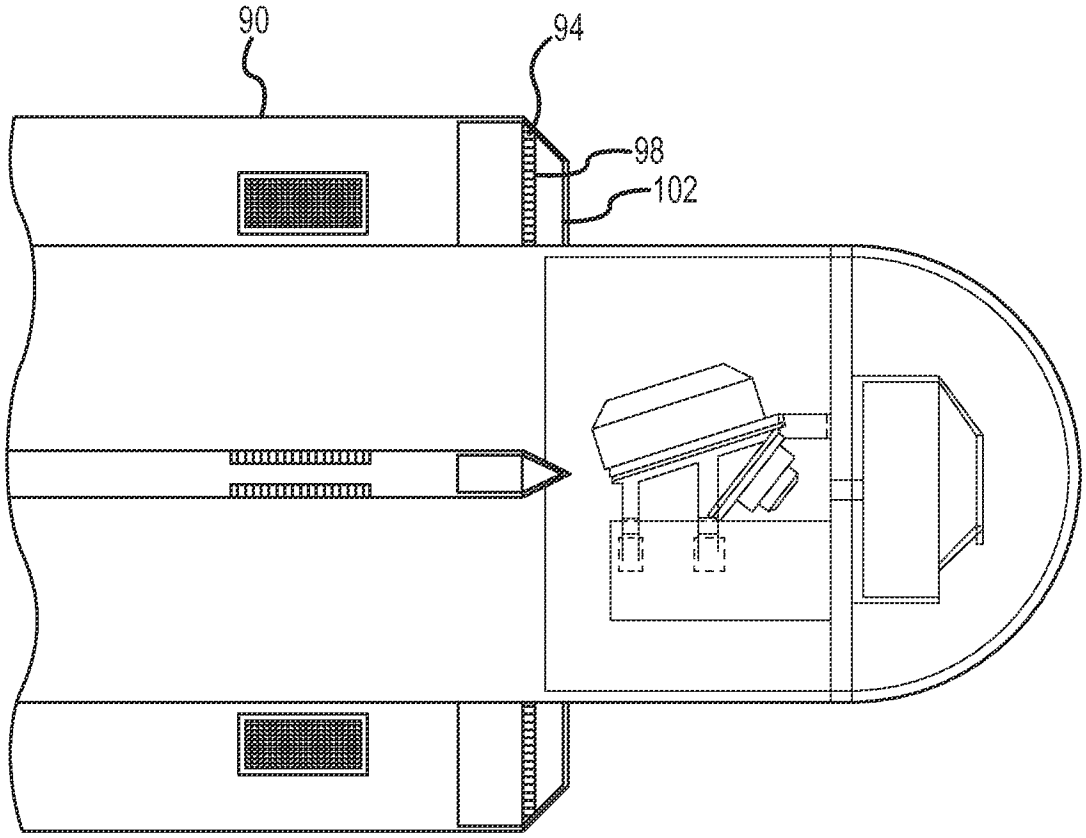
Figure 3B:
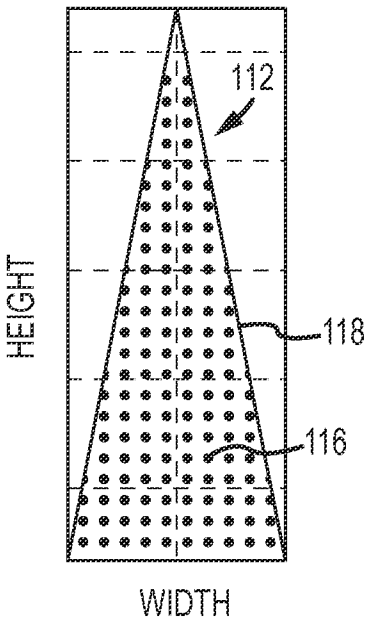
FIGS. 3*a*, 3*b*, 3*c* and 3*d* are diagrams of an embodiment of an AESA array geometry, the layout of the radiating elements in a single AESA array, the beam pattern for a single array and the beam pattern of the full array.
Figure 3A:
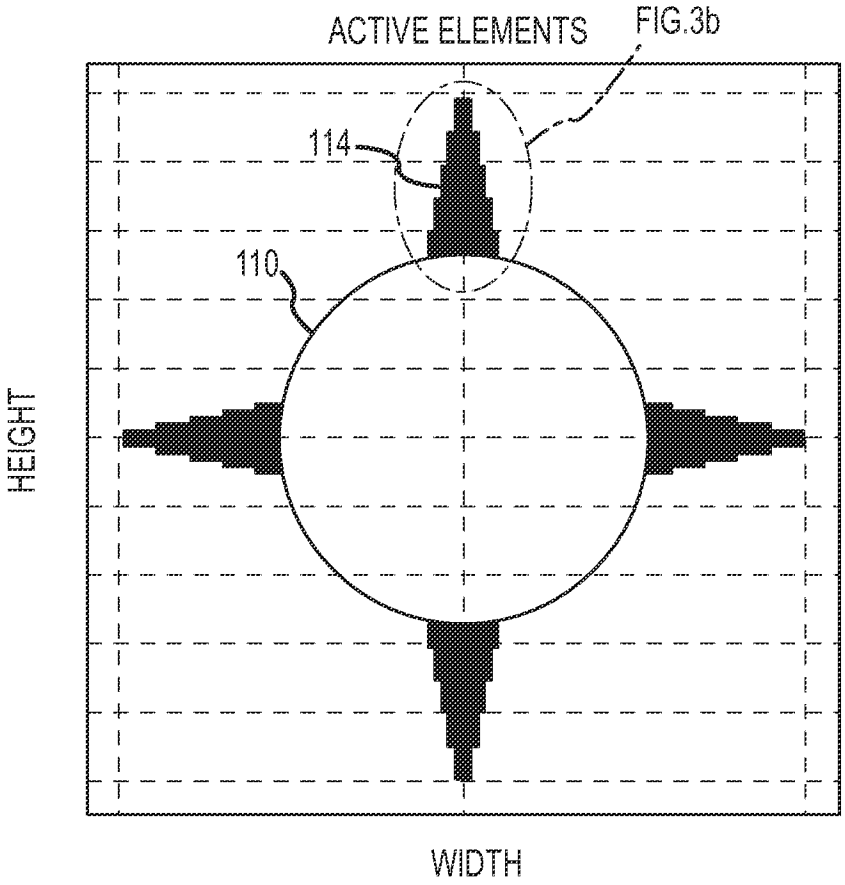
Figure 3D:
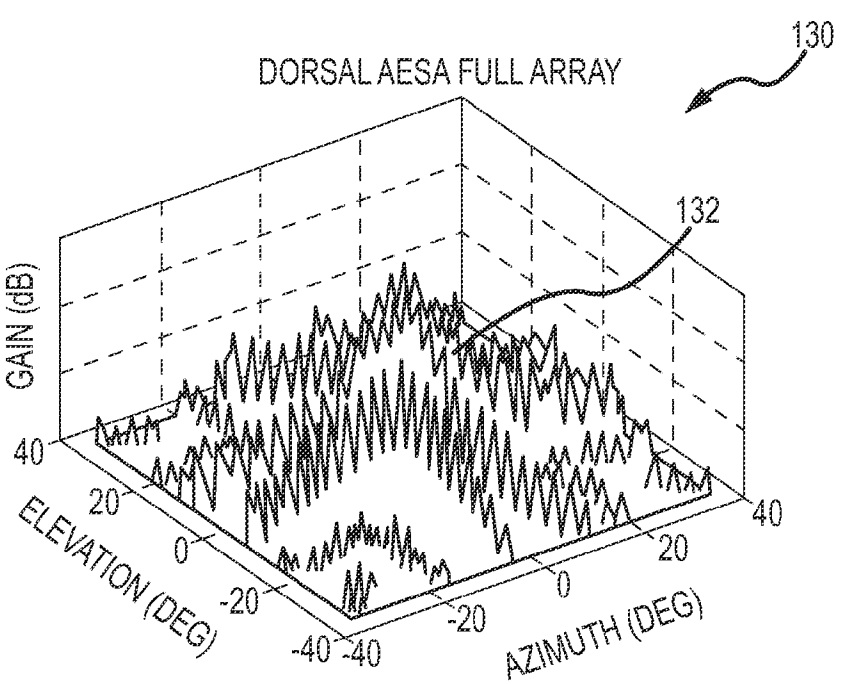
Figure 3C:
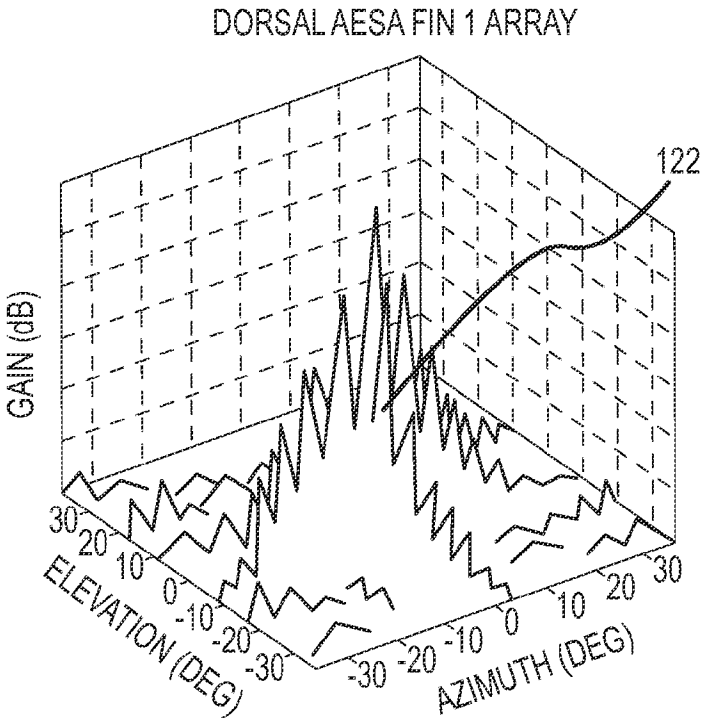

Referring now to FIGS. 2*a* and 2*b*, in this embodiment a dorsal fin 90 has a rectangular cross-section that defines a rectangularly shaped forward-facing surface 92 on which an AESA array 94 is placed. AESA array 94 comprises a rectangular arrangement of radiating elements 98 coupled to a power source. Radome element 102 has a wedge shape that is complementary to the rectangular cross-section of fin 90.

Referring now to FIGS. 3*a*, 3*b*, 3*c* and 3*d*, an end-on view of an interceptor 110 illustrates the array geometry of 4 triangularly shaped AESA arrays 112 positioned on the four dorsal fins 114 spaced at 90 degrees about the circumference of the interceptor. Radiating elements 116 are arranged in a triangular pattern on the fin's forward-facing surface 118.

In a configuration, the gain response 120 of an individual AESA array 112 has a 1-way 3 dB beamwidth 122 that is asymmetric in Az and El depending on the orientation of the fin. The large gap between the apertures (arrays) creates multiple grating lobes in the response. Concurrent independent operation of the individual arrays can be facilitated by use of mutually orthogonal waveforms and frequency diversity for each array. The control circuitry should control the independent beam patterns to avoid attempting to look through the interceptor body, or to ignore the return should the beam look through the interceptor body.

In this configuration, the gain response 130 of the full AESA array has numerous grating lobes 132 with a 1-way 3 dB beamwidth that is approximately symmetric in AZ and El and considerably narrower than that of a single array. The 1-way gain of the full AESA array is significantly greater than that of a single array. The large central obscuration caused by the missile body creates numerous grating lobes when the four arrays are combined to form a full array. Angles derived from the full array must be disambiguated (i.e. the angle measurement must be attributed to the correct lobe). For disambiguation, it may be sufficient to combine the target state estimates from the independent fin arrays. In fact, the fused target state may be good enough to make forming the full array unnecessary. The control circuitry should control the individual beam patterns to avoid attempting to look through the interceptor body to form a combined beam pattern, or to ignore the individual return should the beam look through the interceptor body as part of the combined return.

Figure 4:
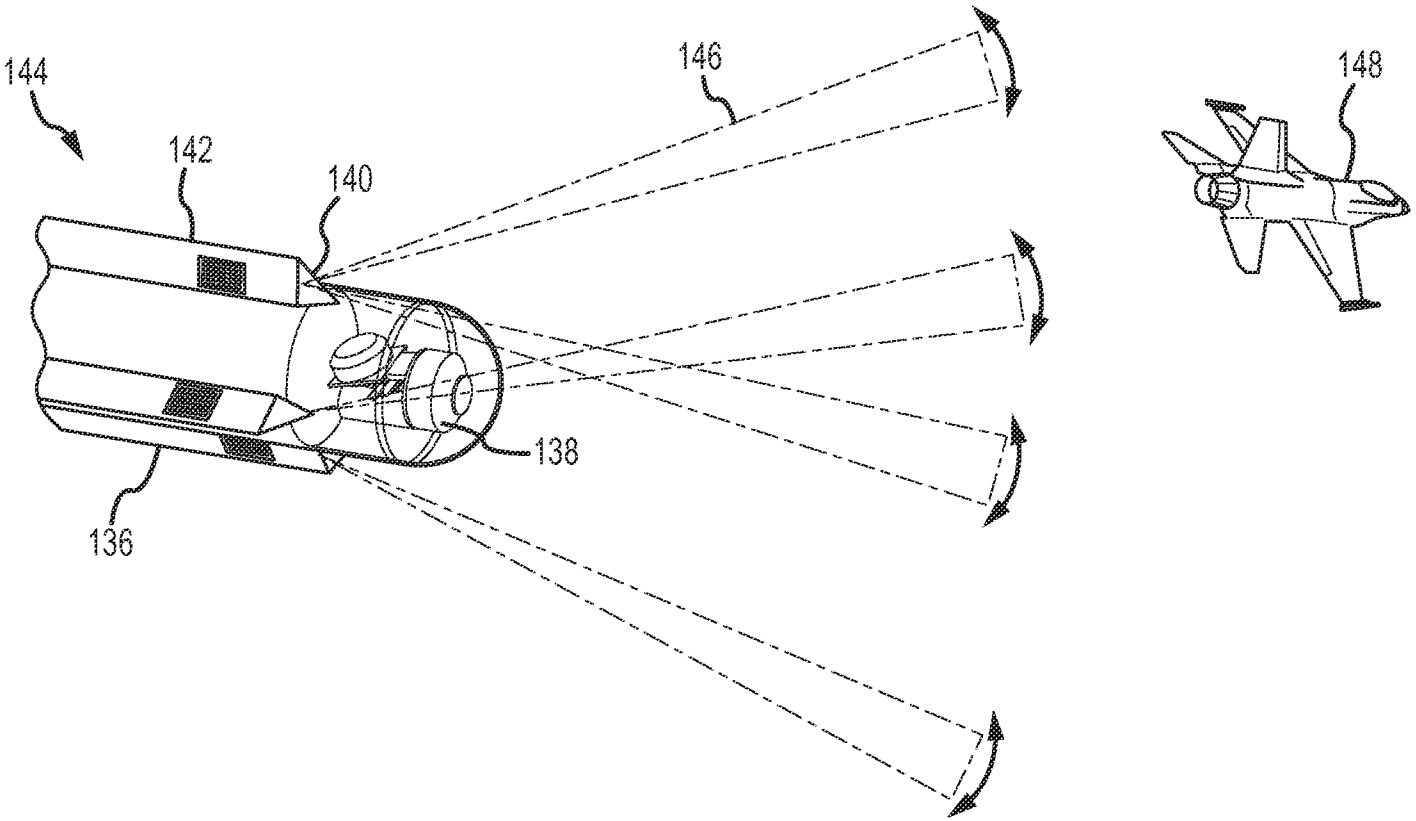
FIG. 4 is a diagram illustrating independent control of the AESA arrays to perform search and acquisition on a target.
Figure 5:
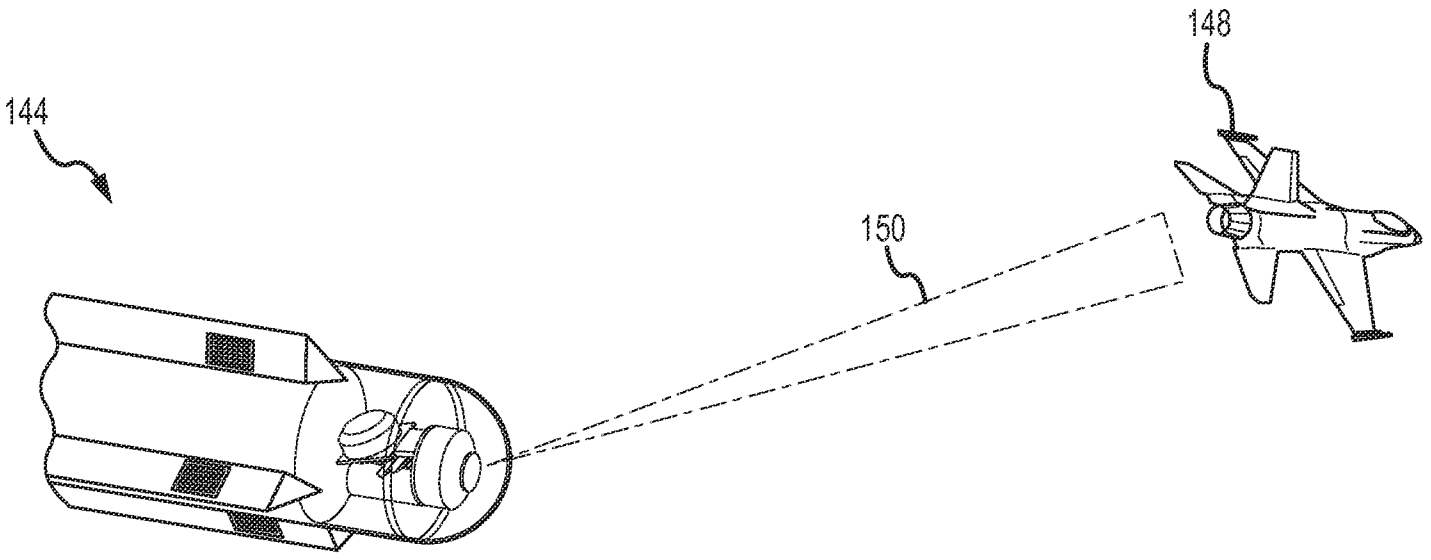
FIG. 5 is a diagram illustrating coordinated control of the AESA arrays to provide a combined beam pattern for tracking the target.
Figure 6:
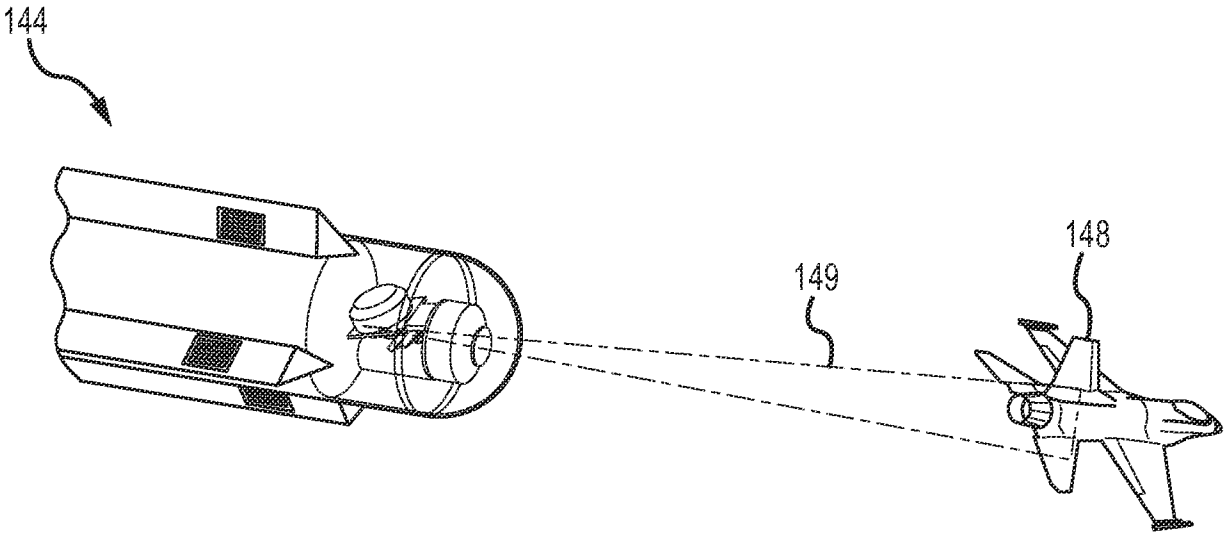
FIG. 6 is a diagram illustrating the use of the strapdown IR seeker with a fixed narrow field of view (FOV) for last mile targeting.

Referring now to FIGS. 4, 5 and 6, an embodiment of a dual-mode system that combines a fin-mounted AESA system 136 and a boresighted strapdown IR seeker 138 enables a new scenario for RF target engagement. As shown in FIG. 4, the individual arrays 140 mounted on the forward-facing surfaces of the dorsal fins 142 of an interceptor 144 are individually controlled to scan their beams 146 to search for and acquire a target 148. In this manner, the multiple beams 146 can simultaneously search different quadrants of a much larger FOR in front of the interceptor with sufficient sensitivity to detect and acquire target 148. Once acquired, as shown in FIG. 5 the individual arrays 140 are controlled to form a single combined beam 150 that is scanned to track the target. Once the range-to-target has closed, the interceptor switches to the IR seeker for terminal or endgame targeting to destroy target 148. At this point, the enhanced resolution of the IR seeker can be used to collect passive IR 149 provide more precise targeting information. The range-to-target and time to final engagement are such that an IR seeker with a fixed FOV is sufficient to conduct the terminal operations.

Figure 7:
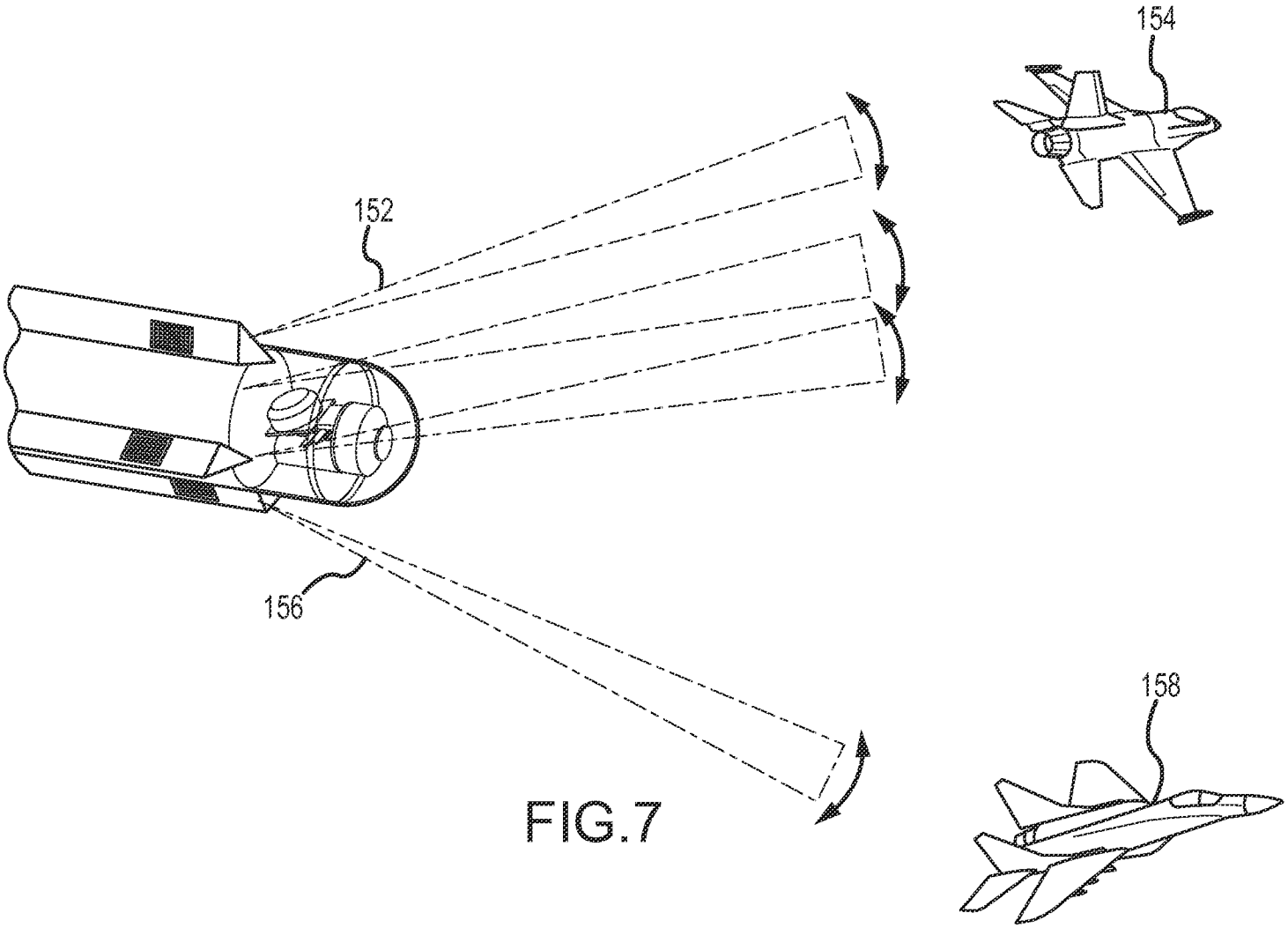
FIG. 7 is a diagram illustrating independent control of one or more AESA arrays for tracking and acquisition and of an AESA array for RF communication with another station.

Referring now to FIG. 7, an AESA system 150 may be used to provide simultaneous RF target engagement and RF communications for interceptor 151. One or more of the AESA arrays 152 may be controlled to perform RF target engagement e.g. search, acquisition or targeting of a target 154 while one or more of the AESA arrays 156 may be controlled for RF communications with a communication station 158. The communication station 158 could be another interceptor, another airborne platform or a ground control station for example. RF control may be passed from one AESA array 156 to another to maintain data link between the interceptor and the communication station due to relative motion between the interceptor and the communication station.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An interceptor, comprising:

an airframe having a longitudinal axis;

a plurality of dorsal fins positioned about a circumference of the airframe and running parallel to the longitudinal axis, each said dorsal fin having a forward-facing surface that is substantially perpendicular to the longitudinal axis;

an adaptive electronically steerable array (AESA) system comprising a plurality of AESA arrays, each AESA array placed on the forward-facing surface of a different one of said dorsal fins, each said AESA array comprising a plurality of radiating elements configured to emit radio frequency (RF) energy substantially perpendicular to the forward-facing surface and substantially parallel to the longitudinal axis;

a plurality of RF transmissive radome elements, each radome element placed on the forward-facing surface of a different one of said plurality of dorsal fins over the respective one of said AESA arrays, each said radome element having an aerodynamic shape complementary to a cross-section of said dorsal fin; and control circuitry to configure the plurality of AESA arrays for RF target engagement.

2. The interceptor of claim 1, wherein said dorsal fins have side-facing surfaces, further comprising:

an additional plurality of AESA arrays, each one of said additional plurality of AESA arrays comprising a plurality of radiating elements placed on the side-facing surface of a different one of said plurality of dorsal fins, wherein said control circuitry configures the additional plurality of AESA arrays for RF communication.

3. The interceptor of claim 1, wherein said dorsal fins have aft-facing surfaces that are substantially perpendicular to the longitudinal axis, further comprising:

an additional plurality of AESA arrays, each one of said additional plurality of AESA arrays comprising a plurality of radiating elements placed on the aft-facing surface of a different one of said plurality of dorsal fins, wherein said control circuitry configures the additional plurality of AESA arrays for RF communication.

4. The interceptor of claim 1, wherein the control circuitry configures the plurality of AESA arrays with independent beam patterns.

5. The interceptor of claim 4, wherein the control circuitry configures the plurality of AESA arrays to scan the independent beam patterns over different regions of a field-of-regard (FOR) to search for and acquire a target.

6. The interceptor of claim 5, wherein once the target is acquired, the control circuitry configures the plurality of AESA arrays to produce a combined beam pattern to track the target, said combined beam pattern having a greater sensitivity than any one of said individual beam patterns.

7. The interceptor of claim 6, wherein the interceptor comprises a boresight strap down infrared (IR) seeker having a FOR less than the FOR of the independent beam patterns, wherein at terminal, said control circuitry activates the boresight strap down IR seeker to engage the target.

8. The interceptor of claim 1, wherein the control circuitry configures the plurality of AESA arrays to produce a combined beam pattern.

9. The interceptor of claim 1, wherein the control circuitry configures the plurality of AESA arrays for RF target engagement and RF communications with a communication station.

10. The interceptor of claim 9, wherein the control circuitry configures at least one said AESA array for RF target engagement and a different at least one said AESA array for RF communications with the communication station for simultaneous RF target engagement and RF communications.

11. The interceptor of claim 9, wherein the control circuitry configures at least one said AESA array for RF target engagement and a different at least one said AESA array for RF communications with the communication station for serial RF target engagement and RF communications.

12. The interceptor of claim 10, wherein the control circuitry configures the plurality of AESA arrays for multi-band operations.

13. The interceptor of claim 1, wherein the interceptor further comprises a forward looking non-gimbaled IR seeker mounted on the front of the airframe and an axis-symmetric IR transmissive dome mounted over the forward looking non-gimbaled IR seeker, wherein no AESA array is mounted inside the IR transmissive dome.

14. The missile interceptor of claim 1, wherein each said dorsal fin has a triangular cross-section that defines a triangularly shaped forward-facing surface on which the AESA arrays are placed, each said AESA array comprising a triangular arrangement of said plurality of radiating elements, wherein said radome element has a solid triangular shape.

15. An interceptor comprising:

an airframe having a longitudinal axis;

a plurality of aerodynamic control surfaces positioned about the airframe, each control surface having a forward-facing surface that is substantially perpendicular to the longitudinal axis, an adaptive electronically steerable array (AESA) system a plurality of AESA arrays, each AESA array placed on the forward-facing surface of a different one of said plurality of aerodynamic control surfaces, each said AESA array comprising a plurality of radiating elements configured to emit radio frequency (RF) energy substantially perpendicular to the forward-facing surface and substantially parallel to the longitudinal axis;

a plurality of RF transmissive radome elements, each radome element placed on the forward-facing surface of a different one of said plurality of aerodynamic control surfaces over the respective one of said AESA arrays, each said radome element having an aerodynamic shape complementary to said aerodynamic control surface; and control circuitry to configure the plurality of AESA arrays for RF target engagement.

16. The interceptor of claim 15, wherein the control circuitry configures the plurality of AESA arrays both independently and in concert for RF target engagement and configures the plurality of AESA arrays for both RF target engagement and RF communications.

17. The interceptor of claim 15, wherein the interceptor comprises a forward looking non-gimbaled IR seeker mounted on the front of the airframe and an axis-symmetric IR transmissive dome mounted over the IR seeker, wherein no AESA array is mounted inside the IR transmissive dome.

18. A method of radio frequency (RF) target engagement comprising:

positioning adaptive electronically steerable array (AESA) arrays on the forward-facing surfaces of a plurality of dorsal fins positioned about and running parallel to a longitudinal axis of an interceptor, each AESA array comprising a plurality of radiating elements configured to emit RF energy substantially perpendicular to the forward-facing surface and substantially parallel to the longitudinal axis that together define an AESA system;

placing a plurality of RF transmissive radome elements over different ones of said AESA arrays on the forward-facing surfaces, each said radome element having an aerodynamic shape complementary to a cross-section of the dorsal fin; and configuring the arrays for RF target engagement.

19. The method of claim 18, wherein the AESA arrays are configured both independently and in concert for RF target engagement.

20. The method of claim 18, wherein the AESA arrays are configured for both RF target engagement and RF communications.

21. The method of claim 18, further comprising mounting a forward looking non-gimbaled IR seeker on the front of the airframe and mounting an axis-symmetric IR transmissive dome over the IR seeker without mounting an AESA array inside the IR transmissive dome.

* * * * *